US008284978B1

(12) United States Patent
Strauser

(10) Patent No.: US 8,284,978 B1
(45) Date of Patent: Oct. 9, 2012

(54) SYSTEM, METHOD AND APPARATUS FOR DIRECTIONAL SPEAKERS

(76) Inventor: Jack Strauser, Pinellas Park, FL (US)

( * ) Notice: Subject to any disclaimer, the term of this patent is extended or adjusted under 35 U.S.C. 154(b) by 208 days.

(21) Appl. No.: 12/889,941

(22) Filed: Sep. 24, 2010

(51) Int. Cl.
*H04R 9/08* (2006.01)

(52) U.S. Cl. ..... 381/365; 381/366

(58) Field of Classification Search ..... 381/87, 381/334, 386, 387; 248/127, 346.01, 346.03, 248/346.06, 346.07; 84/327, 328, 329, 421, 84/453

See application file for complete search history.

(56) References Cited

U.S. PATENT DOCUMENTS

| | | | | |
|---|---|---|---|---|
| 2002/0066837 | A1 * | 6/2002 | Dunbar | 248/122.1 |
| 2009/0292851 | A1 | 11/2009 | Mead et al. | |
| 2010/0158287 | A1 * | 6/2010 | Xu et al. | 381/387 |

FOREIGN PATENT DOCUMENTS

| | | | |
|---|---|---|---|
| JP | 07023312 | A * | 1/1995 |
| KR | 10-2002-0017647 | A | 3/2002 |
| KR | 10-0884503 | B1 | 2/2009 |
| KR | 10-2009-0116275 | A | 11/2009 |
| WO | 2004-029891 | A1 | 4/2004 |

* cited by examiner

*Primary Examiner* — Brian Ensey
(74) *Attorney, Agent, or Firm* — Larson & Larson, P.A.; Frank Liebenow; Justin Miller

(57) ABSTRACT

An application for a music system with rotatable directional speakers includes a console that faces a performer and is mounted on a pedestal. A base is connected to a bottom end of the pedestal to provide support to the pedestal and console. At least one speaker is rotatably mounted on a first side of the pedestal at an angle and at least one other speaker is rotatably mounted on a second side of the pedestal at the angle. When the speakers are rotated away from the performer, a direction of sound from the speakers diverges with respect to the music system and when the speakers are rotated towards the performer, the direction of sound from the speakers converges toward the performer.

15 Claims, 8 Drawing Sheets

SYSTEM, METHOD AND APPARATUS FOR DIRECTIONAL SPEAKERS

CROSS-REFERENCE TO RELATED APPLICATION

This application is related to a co-pending application, filed even date, Ser. No. 12/889,951, titled, "SYSTEM, METHOD AND APPARATUS FOR HOLDING A DEVICE AND CONTAINING A MICROPHONE". This application is also related to a co-pending application, filed even date, Ser. No. 12/889,983, titled, "SYSTEM, METHOD AND APPARATUS FOR SUPPORTING AND PROVIDING POWER TO A MUSIC PLAYER."

FIELD

This invention relates to the field of music devices and more particularly to a music system having rotatable speakers.

BACKGROUND

Many existing musical devices such as portable stereo systems and portable karaoke systems have speakers for reproducing sound that is enjoyed by the performer, an audience or both. Such systems either have attached speakers (built-in) or detached speakers connected by a cable or wirelessly. When the music system is projecting music to an audience, there is no way to adjust the directionality of the speakers when they are attached. For example, both speakers are typically aimed directly towards the front of the music system (e.g. parallel and perpendicular to an imaginary flat front surface of the music player). This limits the dispersion of the sound and concentrates the sound on a few people preferably directly in front of the music system. When detached speakers are provided, often, the users will position the speakers at an angle towards the audience to affect the dispersion/divergence of the sound from the speakers, but this is not possible with built-in speakers.

When the same music system is used in a more private arrangement, it is desired that the speakers angle inwardly, directing the sound at a single person such as the karaoke performer when the music system is a karaoke system. Again, this is not possible with build-in speakers since they are positioned to direct sound in a straight line and not concentrate the sound towards the performer. In systems that have detached speakers, often the performer will angle the detached speakers inwardly toward the performer.

For many reasons, it is desired to have attached speakers to reduce wire clutter, keep components together, lift the speakers off from the floor, etc. It is also desired that the speakers be aimed correctly at the audience and/or performer.

What is needed is a music system that has attached speakers that direct sound outwardly to an audience or, when rotated towards the performer, concentrate sound towards the performer.

SUMMARY

In one embodiment, a music system with rotatable directional speakers is disclosed including a console that faces a performer and is mounted on a pedestal. A base is connected to a bottom end of the pedestal to provide support to the pedestal and console. At least one speaker is rotatably mounted on a first side of the pedestal at an angle and at least one other speaker is rotatably mounted on a second side of the pedestal at the angle. When the speakers are rotated away from the performer, a direction of sound from the speakers diverges with respect to the music system and when the speakers are rotated towards the performer, the direction of sound from the speakers converges toward the performer.

In another embodiment, a method of using a music system is disclosed. The music system has a console that faces a performer and is mounted on and supported by a pedestal and has at least two speakers that are rotatably mounted on alternating sides of the pedestal at an angle. The method includes rotating the speakers away from the performer during a time when the performer has an audience, thereby the speakers are aimed at the audience and sound from the speaker converges towards the audience. The method also includes rotating the speakers toward the performer during a time when the performer is listening to their own performance, thereby the speakers are aimed at the performer and sound from the speaker diverge towards a point near the performer.

In another embodiment, a music system with rotatable directional speakers is disclosed including a console that faces a performer and is mounted atop a pedestal. The pedestal is supported by a base. The music system included at least two speakers that are rotatably mounted on opposing sides of the pedestal at an angle such that when the speakers are rotated away from the performer, a direction of sound from the speakers diverges with respect to the music system and when the speakers are rotated towards the performer, the direction of sound from the speakers converges toward the performer.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
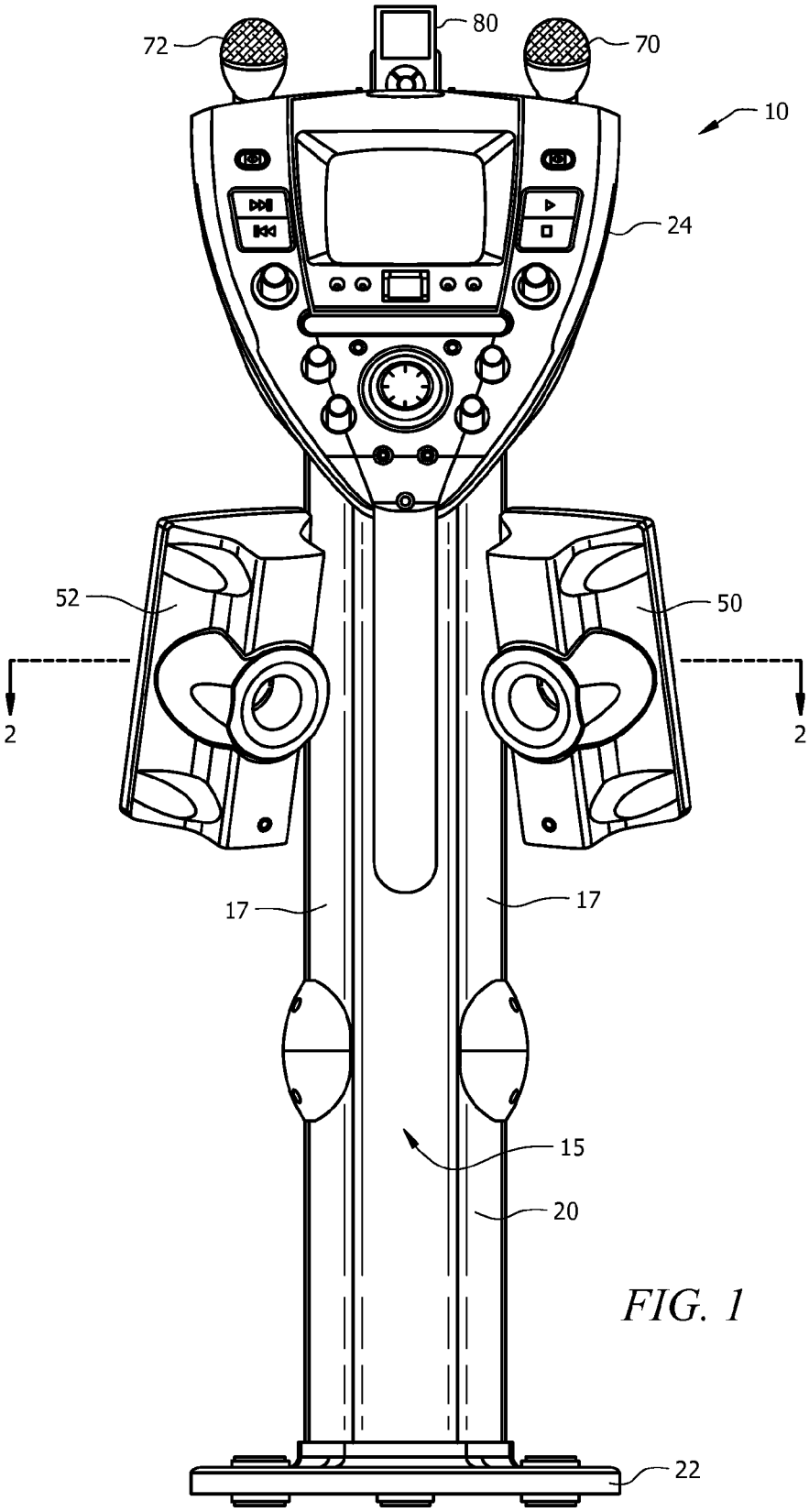
FIG. 1 illustrates a front perspective view of a directional speaker system.

Reference will now be made in detail to the presently preferred embodiments of the invention, examples of which are illustrated in the accompanying drawings. Throughout the following detailed description, the same reference numerals refer to the same elements in all figures.

Figure 2A:
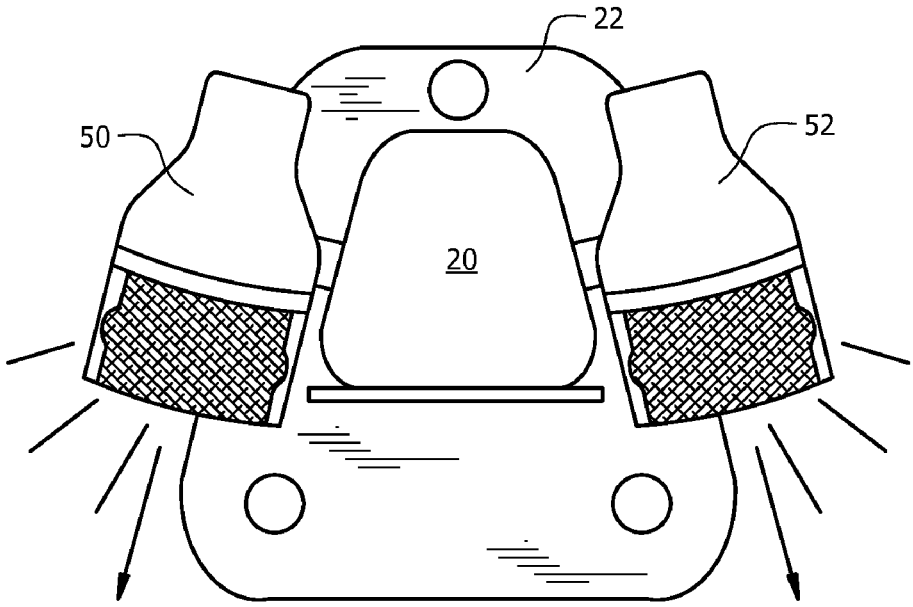
FIG. 2A illustrates a top view of the directional speaker system with speakers facing an audience.
Figure 2B:
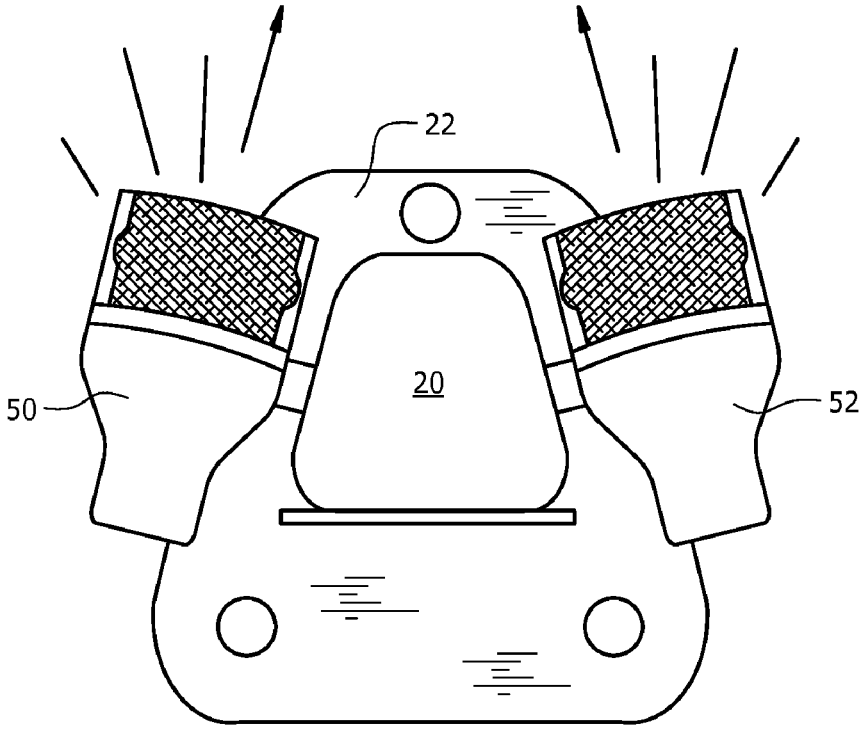
FIG. 2B illustrates a top view of the directional speaker system with speakers facing a performer.

Referring to FIGS. 1, 2A, 2B, perspective view of a directional speaker system is shown. For explanation purposes, a pedestal karaoke system 10 is used as an exemplary device. The elements of the disclosed invention are applicable to other portable and/or stationary devices and are not limited to a karaoke system.

Figure 7:
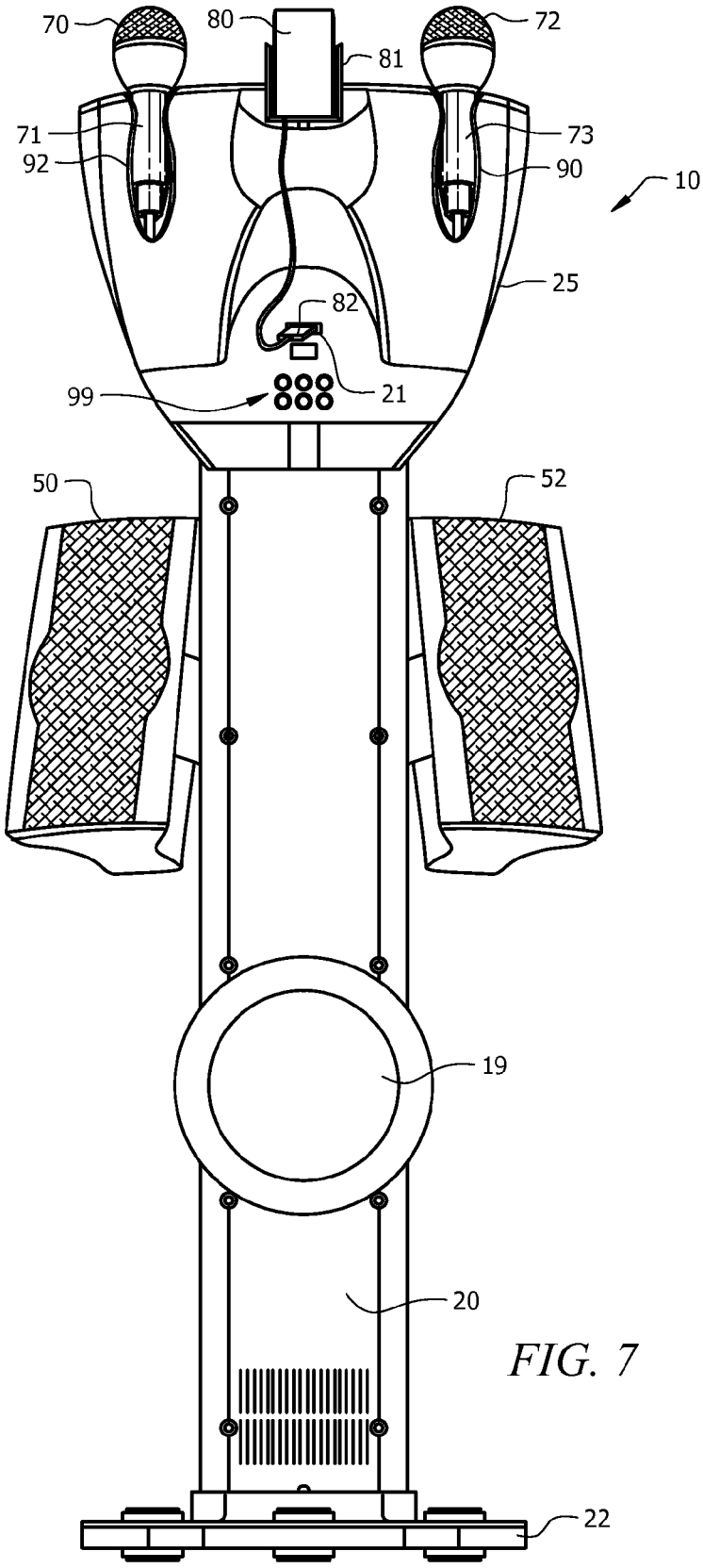
FIG. 7 illustrates a rear perspective view of the system.
Figure 8:
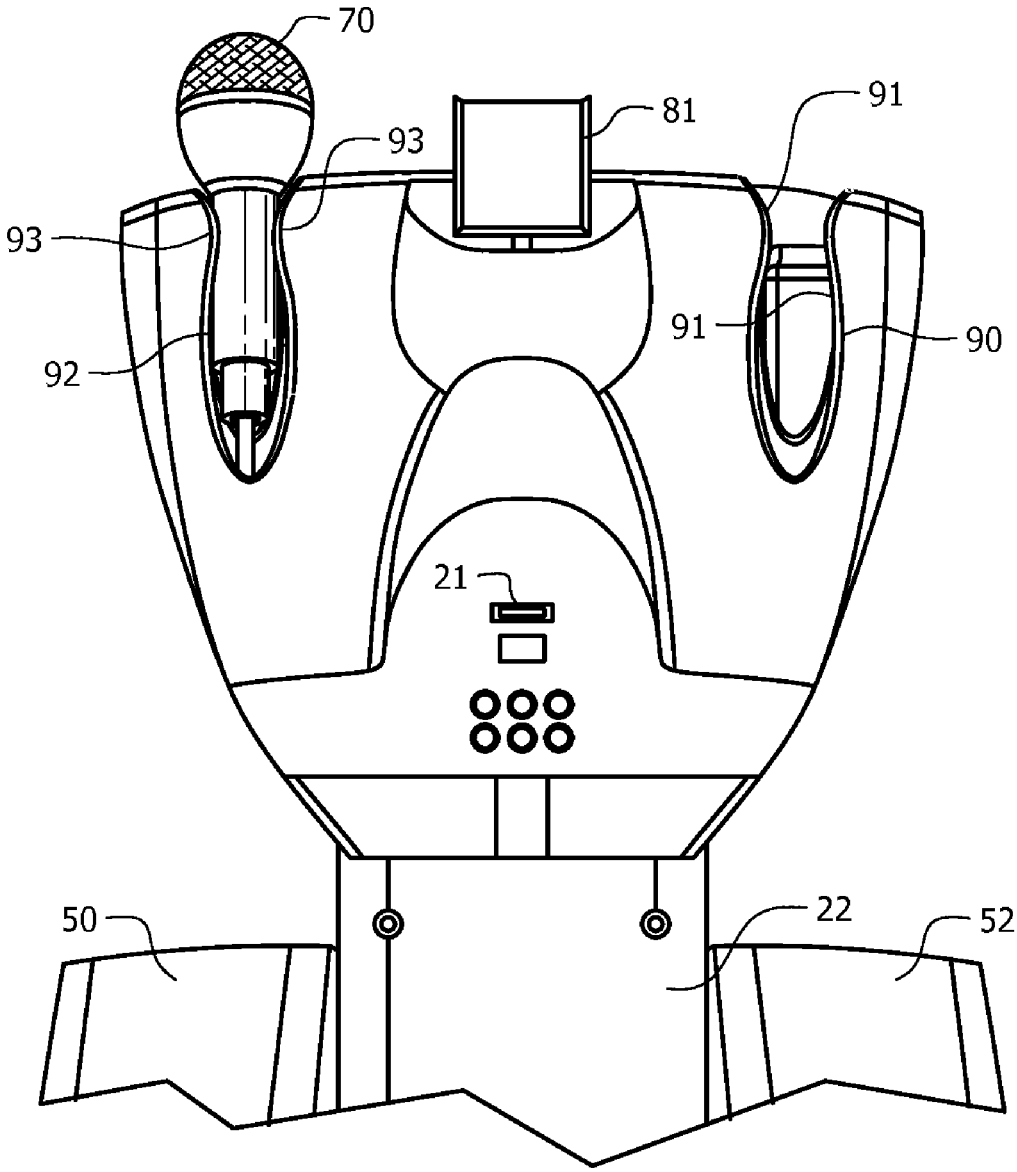
FIG. 8 illustrates a rear perspective view of the system showing handle/microphone storage in detail.
Figure 9:
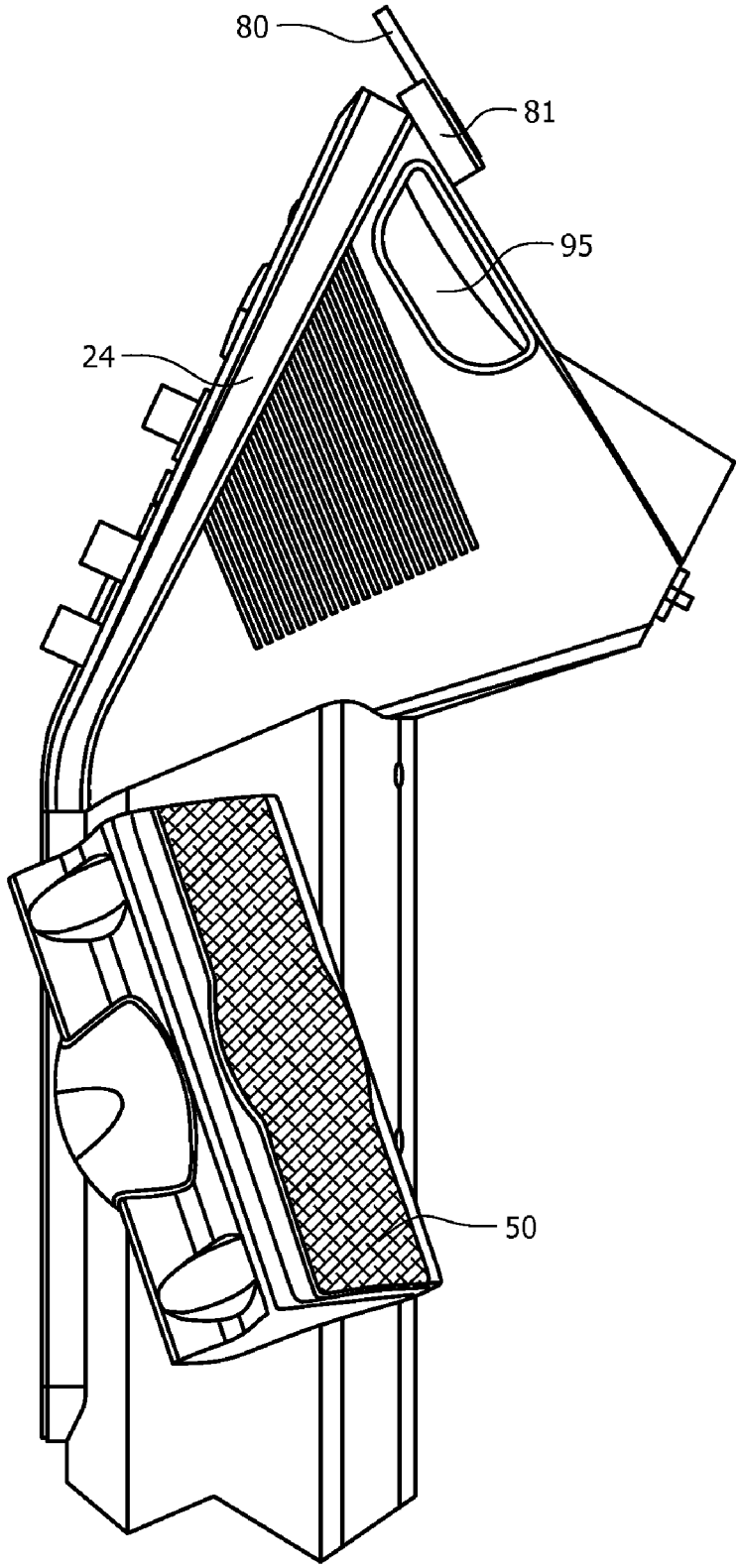
FIG. 9 illustrates a side perspective view of the system.

The exemplary system 10 has a system console 24 supported by a pedestal 20. The system console 24 typically has controls (e.g. volume, play, stop, etc), displays and indicators. In this exemplary system 10, music or karaoke content comes from a music player 80 that is inserted into a cradle 81 (see FIG. 8) and connected to audio inputs 99 of the exemplary system 10. In this example, there are two microphones 70/72 in dual-purpose handle/microphone holders 90/92 (see FIG. 7).

The system is supported by a base 22, preferably wider than the pedestal 20 to reduce the probability of tipping.

The pedestal 20 has side walls 17. Preferably, the side walls 17 of the pedestal 20 are not parallel and purposely angle towards each other getting closer towards the front of the pedestal 15, where the user typically stands. Two speakers 50/52 are rotatably mounted to the side walls 17 of the pedestal 20. The speakers 50/52 are rotated to face away from the user (performer) as shown in FIG. 2A when the user (performer) is using the system 10 with other people (e.g. an audience). Since the speakers 50/52 are angled outwardly due to the angle of the side walls 17, sound from the speakers 50/52 diverge and produce sound that is better distributed to multiple listeners (e.g. the audience). The speakers 50/52 are rotated to face the user (performer) as shown in FIG. 2 when the user (performer) is not concerned with other people hearing the performance. Since the speakers 50/52 are angled inwardly due to the angle of the side walls 17, sound from the speakers 50/52 converge to a point near the user (performer) and produce sound that is concentrated for the enjoyment of the user (performer).

Note that other mechanisms are anticipated that provide the same feature in which the speakers are directed outwardly (sound is aimed away from straight ahead) when facing away from the performer and in which the speakers are directed inwardly (sound is aimed to a focal point near the performer) when facing the performer. For example, in some embodiments, the sides of the pedestal 20 are parallel, but the rotating posts that support the speakers 50/52 are at an angle with respect to the side walls of the pedestal 20. In some embodiments, more than two rotatable speakers 50/52 are anticipated (not shown).

Figure 3:
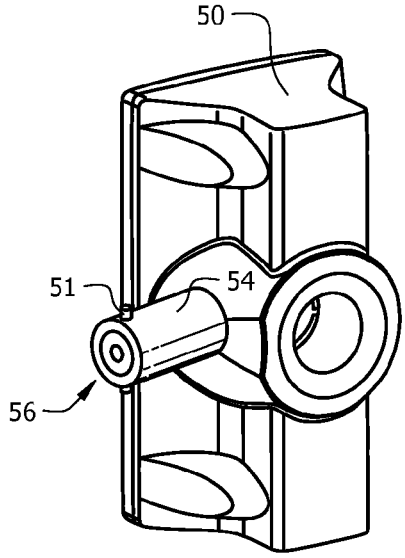
FIG. 3 illustrates a perspective view of a keyed rotating attachment system.
Figure 4:
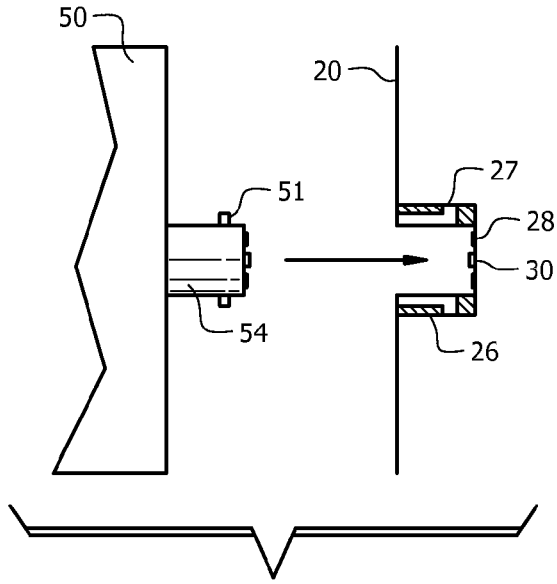
FIG. 4 illustrates a cutaway view of a keyed rotating attachment system.
Figure 5:
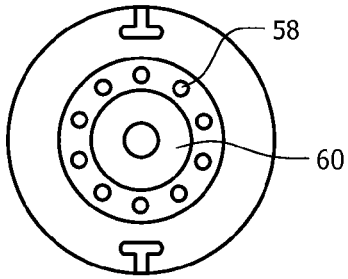
FIG. 5 illustrates a perspective view of an electrical interface of the rotating attachment system.
Figure 6:
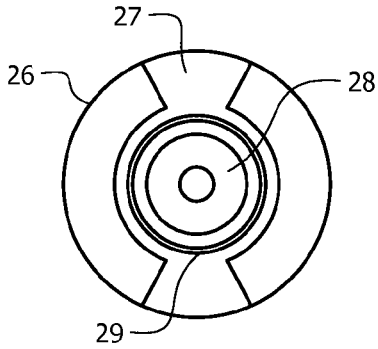
FIG. 6 illustrates a perspective view of a mating electrical interface of the rotating attachment system.

Referring to FIGS. 3-6, views of a keyed rotating attachment system is shown. In FIG. 3, only one speaker 50 is shown (more than one speaker is anticipated). The speaker 50 has a rotating support post 54 that has one or more key posts 51, In some embodiments, a speaker electrical interface 56 is provided to connect the speaker 50/52 to the audio outputs of the system 10 (details shown in FIGS. 5 and 6). The key posts 51 slide into slots 27 of a cavity 26 of the system 10 when the speaker 50/52 is, for example, horizontal (90 degrees rotated from the position shown in FIG. 1). Once inserted, the speakers 50/52 are rotated toward the audience (diverging) or toward the performer (converging), thereby locking the key posts 51 into the slots 27. Any other way of a rotatable connection is anticipated, permanent or removable.

In some embodiments, electrical connections are provided to connect the speakers 50/52 to the audio outputs of the system 10. There are many ways known to electrically connect a rotating device (e.g. a wind generator is rotatably mounted to a tower and electricity passes through the rotatable interface from the generator to the electrical connections at the ground). The example shown has two sets of connectors 58/60 on the speaker support post 54 that connect to contacts 28 and 29 in the cavity 26.

Alternately, in some embodiments, the speakers 50/52 are electrically connected to the system 10 by wires (not shown) instead of through electrical connections associated with the rotating connection.

Referring to FIGS. 7-10, perspective views of the system showing the combined handle/microphone feature will be described. In some embodiments, a music player 80 provides content (e.g. music, karaoke content, video, etc). In such, the music player 80 sits in a cradle 81. For convenience, a power port (e.g. USB port) 21 is provided, into which the power cable plug 82 (e.g. USB plug) is connected to provide power to the music player 80. Although not shown, audio from the music player is connected to the audio input jacks 99 of the system 10.

In some embodiments, the system 10 includes a base speaker 19 (e.g. a sub-woofer), preferably mounted in the pedestal 20.

Figure 10:
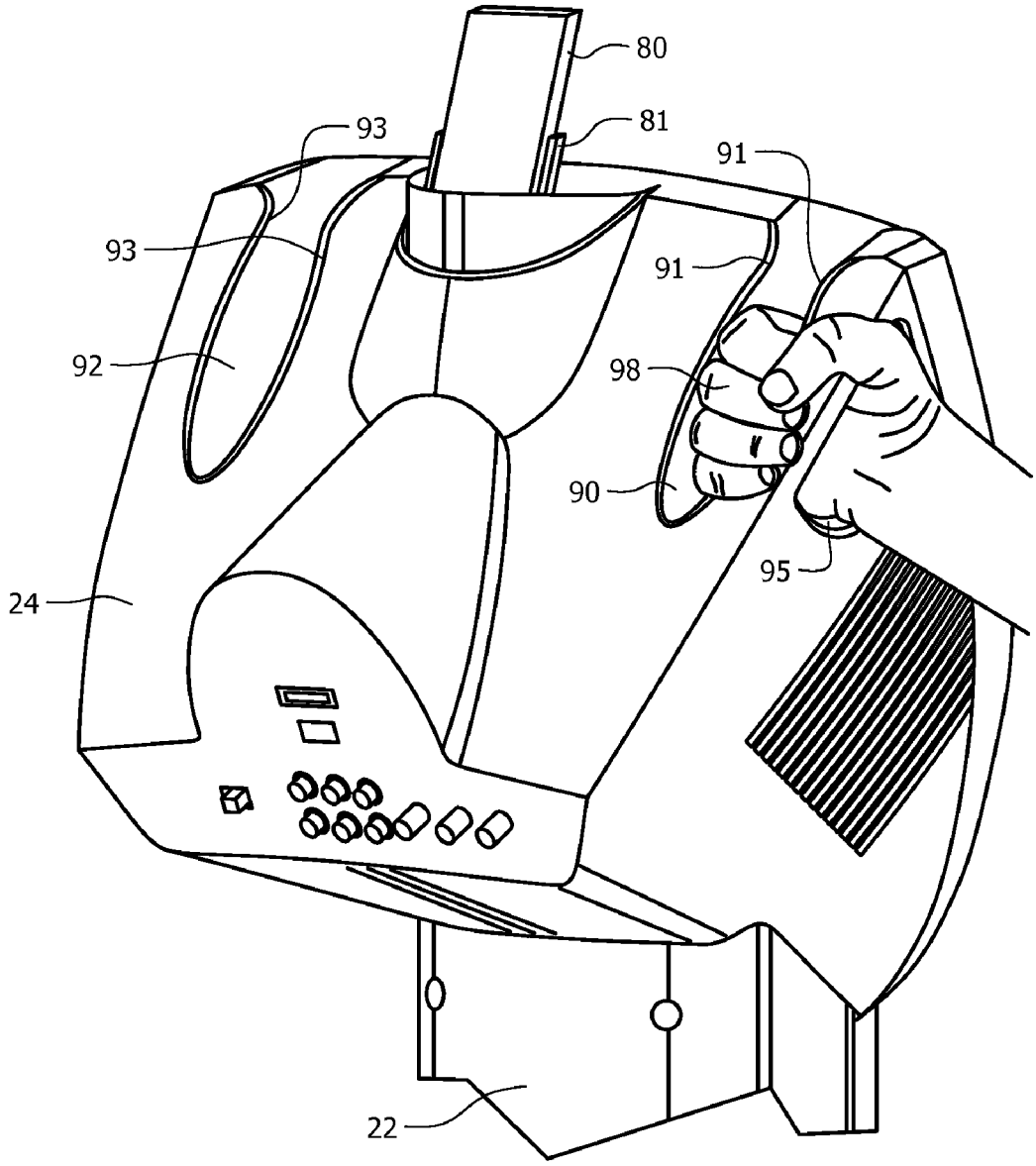
FIG. 10 illustrates a rear perspective view of the system showing handle/microphone in use as a handle.

Handles 71/73 of the microphones 70/72 are inserted into microphone holders 90/92 that double as handles 90/92. A convex surface 91/93 of the microphone holders 90/92 that double as handles 90/92 keeps the microphone handles 71/73 from falling out while providing enough of an opening for a persons fingers 98 (see FIG. 10) when using the microphone holders 90/92 that double as handles 90/92 as handles as shown in FIG. 10. The sides of the system console 24 has a handle opening 95 through which the user's fingers 98 fit, wrapping through and out of the microphone holders 90/92 that double as handles 90/92. The shape of the handle 90/91/92/93/95 is preferably, though not required, shaped to comfortably interface with a typical hand and fingers 98 of a person who carries the system 10.

Figure 11:
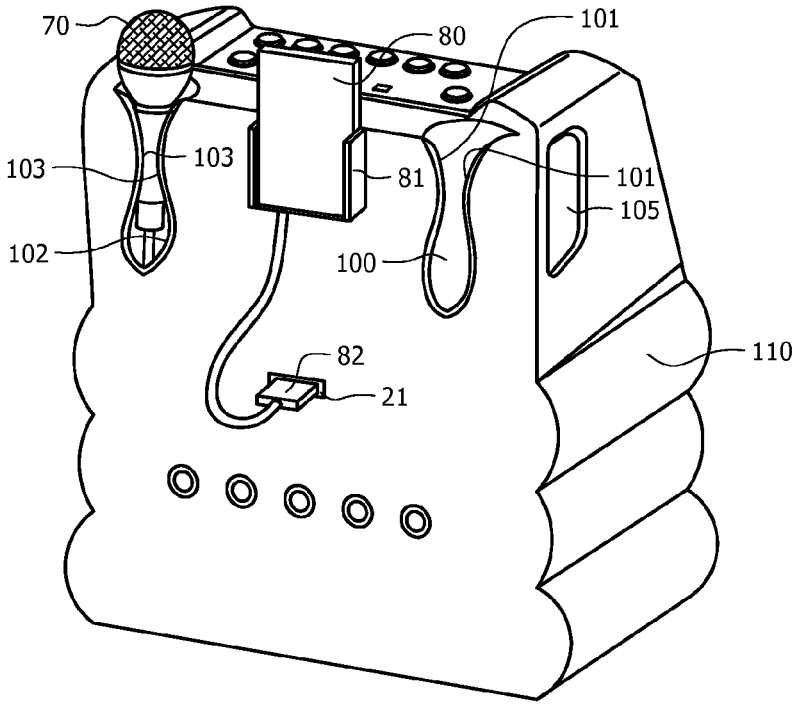
FIG. 11 illustrates a rear perspective view of another exemplary system showing handle/microphone storage in detail.
Figure 12:
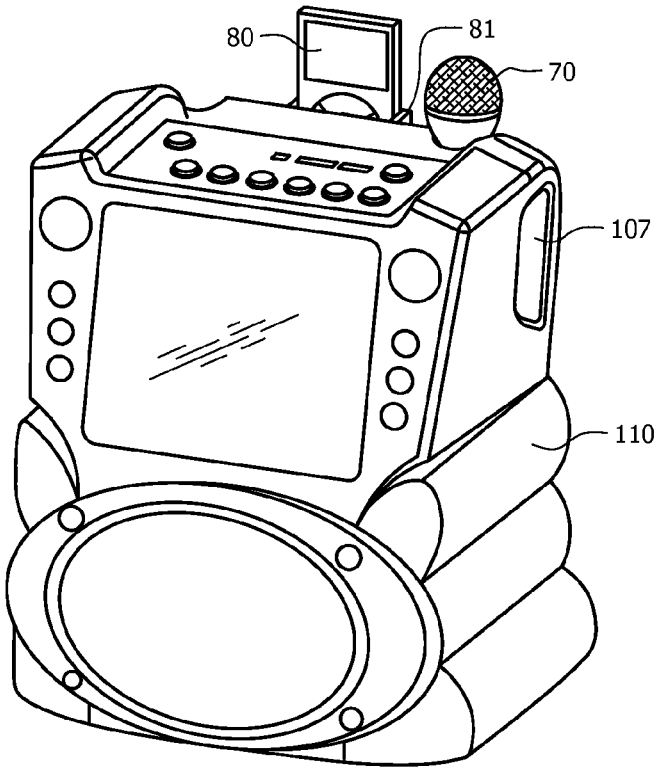
FIG. 12 illustrates a front perspective view of the second exemplary system showing a microphone in storage.

Referring to FIGS. 11 and 12, perspective view of another exemplary system 110 showing handle/microphone storage 100/102 in detail will be described. For storage, the handles 71/73 of the microphones 70/72 (only one microphone 70 is shown) are inserted into microphone holders 100/102 that double as handles 100/102. A convex surface 101/103 of the microphone holders 100/102 that double as handles 100/102 keeps the microphone handles 71/73 from falling out while providing enough of an opening for a persons fingers when using the microphone holders 100/102 that double as handles 100/102 as handles as shown in FIG. 11. The sides of the exemplary system 110 has a handle opening 105/107 through which the user's fingers 98 fit, wrapping through and out of the microphone holders 100/102 that double as handles 100/102. The shape of the handle 100/101/102/103/105/107 is preferably, though not required, shaped to comfortably interface with a typical hand and fingers 98 of a person who carries the system 110.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A music system with rotatable directional speakers, the music system comprising:

a console, the console faces a performer;

a pedestal, a first end of the pedestal connected to and supporting the console;

a base, the base connected to a distal end of the pedestal, the base providing support to the pedestal;

at least one speaker rotatably mounted on a first side of the pedestal at an angle; and at least one speaker rotatably mounted on a second side of the pedestal at another angle;

whereas when the speakers are rotated away from the performer, a direction of sound from the speakers diverges with respect to the music system and when the speakers are rotated towards the performer, the direction of sound from the speakers converges toward the performer;

wherein the speakers are rotatably mounted to the pedestal with a keyed mounting system and the speakers are removable from the pedestal when the speakers are rotated to a horizontal position and the speakers are not removable from the pedestal when the speakers rotated to a vertical position.

2. The music system of claim 1, wherein side surfaces of the pedestal are angled, converging at a point towards the performer, thereby providing the angle.

3. The music system of claim 1, wherein the keyed mounting system includes a plurality of electrical contacts, the electrical contacts conduct audio signals from the console and/or pedestal to the speakers.

4. The music system of claim 1, wherein the electrical contacts form rings and maintain continuity throughout a range of rotation of the speakers.

5. The music system of claim 1, wherein the speakers are connected to the music system by wires.

6. A method of using a music system, the music system having a console that faces a performer and is mounted on and supported by a pedestal and at least two speakers rotatably mounted on alternating sides of the pedestal at an angle, the method comprising:

rotating the at least two speakers away from the performer during a time when the performer has an audience, thereby the at least two speakers are aimed at the audience and sound from the speaker converges towards the audience; and rotating the at least two speakers toward the performer during a time when the performer is listening to their own performance, thereby the at least two speakers are aimed at the performer and sound from the speaker diverge towards a point near the performer wherein side surfaces of the pedestal are angled, converging at a point towards the performer, thereby providing the angle.

7. The method of claim 6, wherein the speakers are rotatably mounted to the pedestal with a keyed mounting system and the speakers are removable from the pedestal when the speakers are rotated to a horizontal position and the speakers are not removable from the pedestal when the speakers rotated to a vertical position.

8. The method of claim 7, wherein the keyed mounting system includes a plurality of electrical contacts, the electrical contacts conduct audio signals from the console and/or pedestal to the speakers.

9. The method of claim 8, wherein the electrical contacts form rings and maintain continuity throughout a range of rotation of the speakers.

10. The method of claim 8, further comprising the step of connecting the speakers to the music system using wires.

11. A music system with rotatable directional speakers, the music system comprising:

a console, the console faces a performer;

a pedestal, a first end of the pedestal connected to and supporting the console;

a base, the base connected to a distal end of the pedestal, the base providing support to the pedestal;

at least two speakers; and means for rotatably mounting the at least two speakers on opposing sides of the pedestal at an angle such that when the speakers are rotated away from the performer, a direction of sound from the speakers diverges with respect to the music system and when the speakers are rotated towards the performer, the direction of sound from the speakers converges toward the performer;

wherein side surfaces of the pedestal are angled, converging at a point towards the performer, thereby providing the angle.

12. The music system of claim 11, wherein the means for rotatably mounting includes a key and the key enables the speakers to be removable from the pedestal when the speakers are rotated to a horizontal position and the key disables the speakers from being removed from the pedestal when the speakers rotated to a vertical position.

13. The music system of claim 11, wherein the means for rotatably mounting includes a plurality of electrical contacts, the electrical contacts conduct audio signals from the console and/or pedestal to the speakers.

14. The music system of claim 13, wherein the electrical contacts form rings and maintain continuity throughout a range of rotation of the speakers.

15. The music system of claim 11, further comprising means for electrically connecting the speakers to the console.

* * * * *